US010993295B2

(12) United States Patent
Adrian et al.

(10) Patent No.: US 10,993,295 B2
(45) Date of Patent: Apr. 27, 2021

(54) MICROWAVE MODE STIRRER APPARATUS WITH MICROWAVE-TRANSMISSIVE REGIONS

(71) Applicant: Corning Incorporated, Corning, NY (US)

(72) Inventors: Paul Andreas Adrian, Weselberg (DE); James Anthony Feldman, Campbell, NY (US); Jacob George, Horseheads, NY (US); Steffen Georg Klingler, Waldfischbach-Burgalben (DE); Nadezhda Pavlovna Paramonova, Saint-Petersburg (RU); Erwin Josef Wersching, Weidenthal (DE)

(73) Assignee: Corning Incorporated, Corning, NY (US)

( * ) Notice: Subject to any disclaimer, the term of this patent is extended or adjusted under 35 U.S.C. 154(b) by 223 days.

(21) Appl. No.: 15/763,504

(22) PCT Filed: Sep. 28, 2016

(86) PCT No.: PCT/US2016/054105
§ 371 (c)(1),
(2) Date: Mar. 27, 2018

(87) PCT Pub. No.: WO2017/058867
PCT Pub. Date: Apr. 6, 2017

(65) Prior Publication Data

US 2018/0288836 A1 Oct. 4, 2018

Related U.S. Application Data

(60) Provisional application No. 62/234,755, filed on Sep. 30, 2015.

(51) Int. Cl.
*H05B 6/74* (2006.01)
*H05B 6/76* (2006.01)

(52) U.S. Cl.
CPC ..... *H05B 6/745* (2013.01); *H05B 2206/046* (2013.01)

(58) Field of Classification Search
CPC ..... H05B 6/745; H05B 2206/046
(Continued)

(56) References Cited

U.S. PATENT DOCUMENTS 2,920,174 A 1/1960 Haagensen
3,505,491 A 4/1970 Freeland
(Continued)

FOREIGN PATENT DOCUMENTS

CN 1485574 A 3/2004
CN 101696811 A 4/2010
(Continued)

OTHER PUBLICATIONS

English Translation of JP2018516549 Office Action dated May 22, 2019, Japan Patent Office, 7 Pgs.
(Continued)

*Primary Examiner* — Quang T Van
(74) *Attorney, Agent, or Firm* — Kurt R. Denniston

(57) ABSTRACT

A microwave mode stirrer apparatus having a stirring member with microwave-transmissive regions is disclosed, along with methods of performing microwave stirring using the microwave mode-stirring apparatus. The microwave-transmissive regions can be in the form of holes or can include microwave-transmissive material. The stirring member can have a variety of configurations, and the microwave-transmissive regions can have a variety of sizes and shapes. A microwave oven that uses the mode stirrer apparatus for drying green ceramic-forming bodies is also disclosed.

13 Claims, 10 Drawing Sheets

(58) Field of Classification Search
USPC ..... 219/751, 745, 746, 748, 749, 750, 757, 219/685, 740; 174/394, 381; 333/252, 333/238
See application file for complete search history.

(56) References Cited

U.S. PATENT DOCUMENTS

| | | | | |
|---|---|---|---|---|
| 3,526,737 | A | 9/1970 | Black | |
| 3,746,823 | A | 7/1973 | Whiteley | |
| 4,019,009 | A | 4/1977 | Kusunoki et al. | |
| 4,053,730 | A | 10/1977 | Baron et al. | |
| 4,092,513 | A | 5/1978 | Rasmussen | |
| 4,144,436 | A | 3/1979 | Hauck | |
| 4,144,437 | A | 3/1979 | Ehlers | |
| 4,327,266 | A | 4/1982 | Austin et al. | |
| 4,424,430 | A * | 1/1984 | Almgren | H05B 6/74 219/749 |
| 4,463,239 | A | 7/1984 | Miller | |
| 5,914,067 | A | 6/1999 | Chung | |
| 5,981,928 | A | 11/1999 | Lee | |
| 6,013,909 | A | 1/2000 | Aramaki et al. | |
| 6,259,078 | B1 | 7/2001 | Araya | |
| 6,269,078 | B1 | 7/2001 | Lakshman et al. | |
| 6,445,826 | B1 | 9/2002 | Kadono | |
| 6,455,826 | B1 | 9/2002 | Araya et al. | |
| 6,706,223 | B1 | 3/2004 | Anderson et al. | |
| 7,596,885 | B2 | 10/2009 | Adrain et al. | |
| 7,862,764 | B2 | 1/2011 | Feldman et al. | |
| 8,020,314 | B2 | 9/2011 | George et al. | |
| 8,729,436 | B2 | 5/2014 | Adrian et al. | |
| 9,504,098 | B2 | 11/2016 | Peelamedu | |
| 2005/0230385 | A1 | 10/2005 | Lee et al. | |
| 2010/0107435 | A1 | 5/2010 | George et al. | |
| 2013/0133220 | A1 | 5/2013 | Feldman et al. | |
| 2014/0197163 | A1 | 7/2014 | Cooper | |
| 2015/0215996 | A1 | 7/2015 | Yoshida et al. | |
| 2017/0045232 | A1 | 2/2017 | Zhang et al. | |

FOREIGN PATENT DOCUMENTS

| | | | |
|---|---|---|---|
| CN | 102202850 | A | 9/2011 |
| CN | 203167938 | U | 9/2013 |
| CN | 203279236 | U | 11/2013 |
| CN | 103718645 | A | 4/2014 |
| CN | 104584686 | A | 4/2015 |
| EP | 0865228 | A1 | 9/1998 |
| GB | 1336851 | A | 11/1973 |
| GB | 2083730 | A | 3/1982 |
| GB | 2329815 | A | 3/1999 |
| JP | S48059244 | U | 7/1973 |
| JP | S49043962 | | 12/1974 |
| JP | S52106857 | U | 8/1977 |
| JP | 2002275770 | A | 9/2002 |
| JP | 2003-504300 | A | 2/2003 |
| JP | 2003-504827 | A | 2/2003 |
| JP | 2007042333 | A | 2/2007 |

OTHER PUBLICATIONS

International Search Report and Written Opinion of the International Searching Authority; PCT/US2016/054105; dated Dec. 9, 2016; 16 Pages; European Patent Office.

English Translation of CN201680057913.4 Office Action dated Apr. 15, 2020; 16 Pages; Chinese Patent Office.

Chinese Patent Application No. 201680057913A, Office Action dated Feb. 3, 2021; 4 pages (English Translation Only); Chinese Patent Office.

* cited by examiner

MICROWAVE MODE STIRRER APPARATUS WITH MICROWAVE-TRANSMISSIVE REGIONS

CROSS-REFERENCE TO RELATED APPLICATIONS

This application is a national stage application under 35 U.S.C. § 371 of International Patent Application Serial No. PCT/US2016/054105, filed on Sep. 28, 2016, which claims the benefit of priority of U.S. Provisional Application Ser. No. 62/234,755 filed on Sep. 30, 2015, the contents of both are relied upon and incorporated herein by reference in their entireties.

FIELD

The present disclosure relates to mode stirrers used in microwave applications, and in particular relates to microwave mode stirrer apparatus with microwave-transmissive regions for use in microwave dryers, such as those used to dry ceramic-forming materials.

BACKGROUND

Microwaves are used in industrial applications to heat and dry items such as pharmaceuticals, plants and herbs, wood, food and ceramic-forming materials.

In some types of microwave ovens, particularly those used for drying green ceramic-forming materials, multiple microwave modes can resonate within the microwave chamber. Such microwave modes can lead to inefficient and/or uneven drying of the ceramic materials.

SUMMARY

An aspect of the disclosure is a mode stirrer apparatus for stirring microwave radiation from at least one microwave radiation source. The mode stirrer apparatus includes: a stirring member having a body that substantially reflects microwave radiation, the stirring member having a perimeter central axis around which the stirring member can rotate; and a plurality of microwave-transmissive regions formed in the body and within the perimeter, wherein the microwave-transmissive regions are configured to substantially transmit the microwave radiation.

Another aspect of the disclosure is a mode stirrer apparatus for stirring microwave radiation emitted by at least one microwave output port in the interior of a microwave dryer for drying green ceramic-forming bodies. The apparatus includes: a corrugated conical body having a central axis, top and bottom surfaces and a plurality of microwave-transmissive regions; a drive shaft having a proximal end and a distal end, with the proximal end operably attached to the corrugated conical body at a point long the central axis; and a drive motor operably attached the distal end of the drive shaft.

Another aspect of the disclosure is a method of drying green ceramic-forming bodies in a drying chamber using microwave radiation emitted from at least one microwave output port. The method includes: reflecting a portion of the emitted microwave radiation using a rotating mode stirring member, wherein the reflected portion has a microwave power PR; transmitting another portion of the microwave radiation through microwave-transmissive regions of the rotating mode stirring member, wherein the transmitted portion has a microwave power PT, and wherein the ratio PT/PR is in the range $0.01 \leq PT/PR \leq 0.5$; and moving the green ceramic-forming bodies through the drying chamber while the transmitted and reflected microwave portions are incident upon the the green ceramic-forming bodies.

Another aspect of the disclosure is a microwave drying system or "microwave oven" for drying green ceramic-forming bodies. The microwave oven includes: a microwave chamber within which green ceramic-forming bodies can be arranged for microwave drying a microwave source to emit microwaves into the microwave chamber; a rotatable mode stirring member disposed in the microwave chamber, the rotatable mode stirring member comprising a body that substantially reflects the microwaves; and wherein the body of the rotatable mode stirring member includes a perimeter and comprises a plurality of microwave-transmissive regions within the perimeter, wherein the microwave-transmissive regions substantially transmit the microwaves and provide greater uniformity of microwave drying of the green ceramic-forming bodies as compared to the absence of the microwave-transmissive regions.

Additional features and advantages are set forth in the Detailed Description that follows, and in part will be readily apparent to those skilled in the art from the description or recognized by practicing the embodiments as described in the written description and claims hereof, as well as the appended drawings. It is to be understood that both the foregoing general description and the following Detailed Description are merely exemplary, and are intended to provide an overview or framework to understand the nature and character of the claims.

BRIEF DESCRIPTION OF THE DRAWINGS

The accompanying drawings are included to provide a further understanding, and are incorporated in and constitute a part of this specification. The drawings illustrate one or more embodiment(s), and together with the Detailed Description serve to explain principles and operation of the various embodiments. As such, the disclosure will become more fully understood from the following Detailed Description, taken in conjunction with the accompanying Figures, in which.

DETAILED DESCRIPTION

Reference is now made in detail to various embodiments of the disclosure, examples of which are illustrated in the accompanying drawings. Whenever possible, the same or like reference numbers and symbols are used throughout the drawings to refer to the same or like parts. The drawings are not necessarily to scale, and one skilled in the art will recognize where the drawings have been simplified to illustrate the key aspects of the disclosure.

The claims as set forth below are incorporated into and constitute part of this Detailed Description.

Cartesian coordinates are shown in some of the Figures for the sake of reference and are not intended to be limiting as to direction or orientation.

In the discussion below, the term "cylindrical" as used with reference to green ceramic-forming bodies is used to describe an object having cross-sectional shape not limited to circular.

The following references are incorporated herein by reference: U.S. Pat. Nos. 6,269,078; 6,445,826; 6,706,223; 7,596,885; 7,862,764; 8,020,314; 8,729,436; and U.S. Pre-Grant Patent Application Publication No. 2013/0133220.

Microwave drying can be used in the production of ceramic-based wares such as substrates and filters that have a honeycomb structure. The ceramic-based filters and substrates are formed via extrusion of a ceramic-forming-batch material. The extruded wet green ware is cut and then processed, which in an example includes passing the wet green ware through a microwave drying system. Ideally, the wet green wares would dry evenly to avoid fissures, cracks, size changes, etc. that adversely impact the final product.

A number of parameters such as dielectric properties, ware geometry (i.e., size, shape, length, etc.), proximity of one ware to another, and the configuration of the microwave dryer all contribute to how evenly a given wet green ware will dry.

In some cases, a mode stirrer apparatus is used to mix or disperse the microwave energy within the microwave dryer. The microwaves can be emitted into the interior of the microwave dryer via microwave ports at the ends of microwave waveguides operably connected to a microwave source. The microwaves will have their energy distributed in microwave modes within the dryer interior, where the modes are defined mainly by the geometry of the microwave dryer, the microwave wavelength and the position of the one or more waveguide ports.

Figure 1:
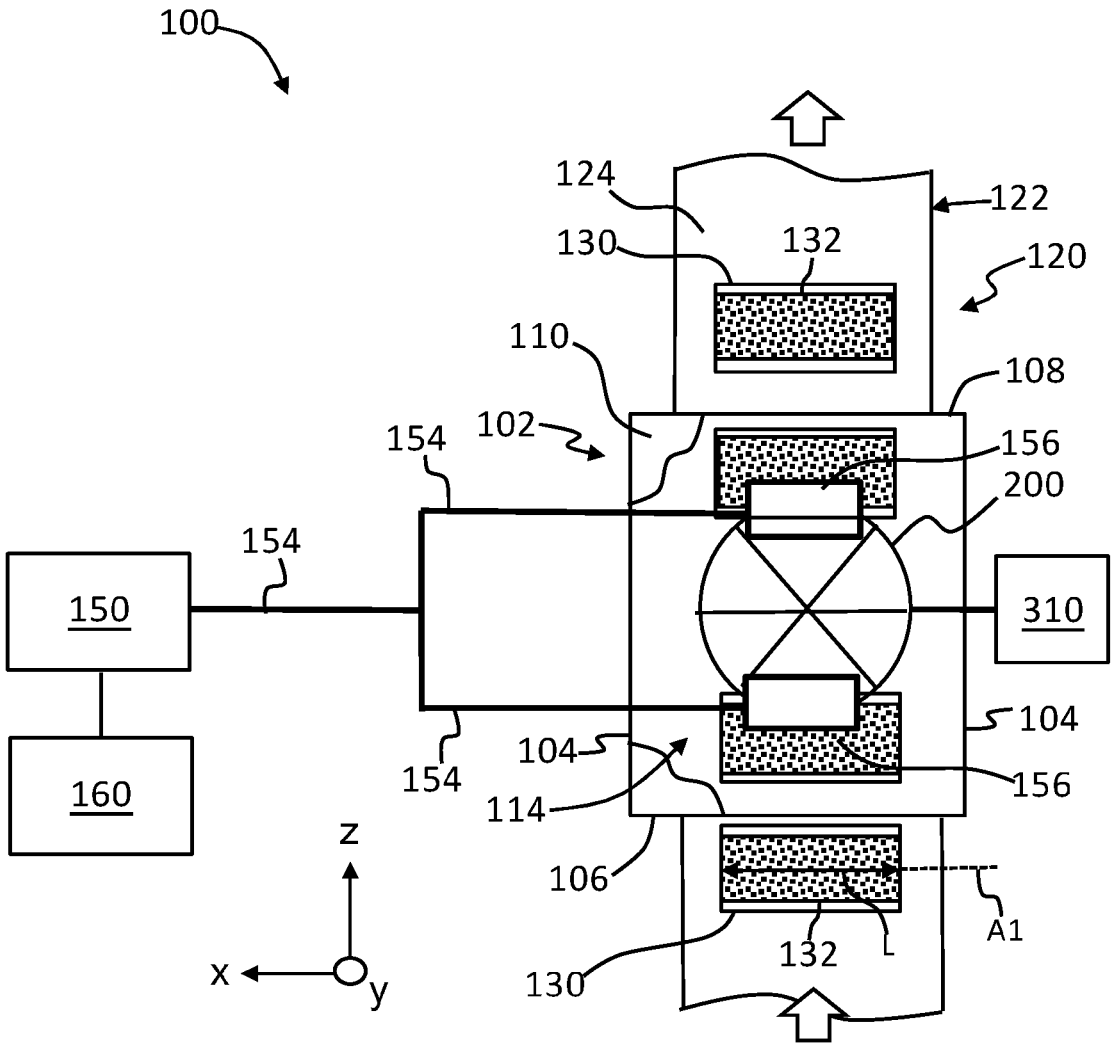
FIG. 1 is a schematic diagram of an example microwave dryer system for heating and drying wet green ceramic-forming bodies, according to embodiments shown and described herein.
Figure 2:
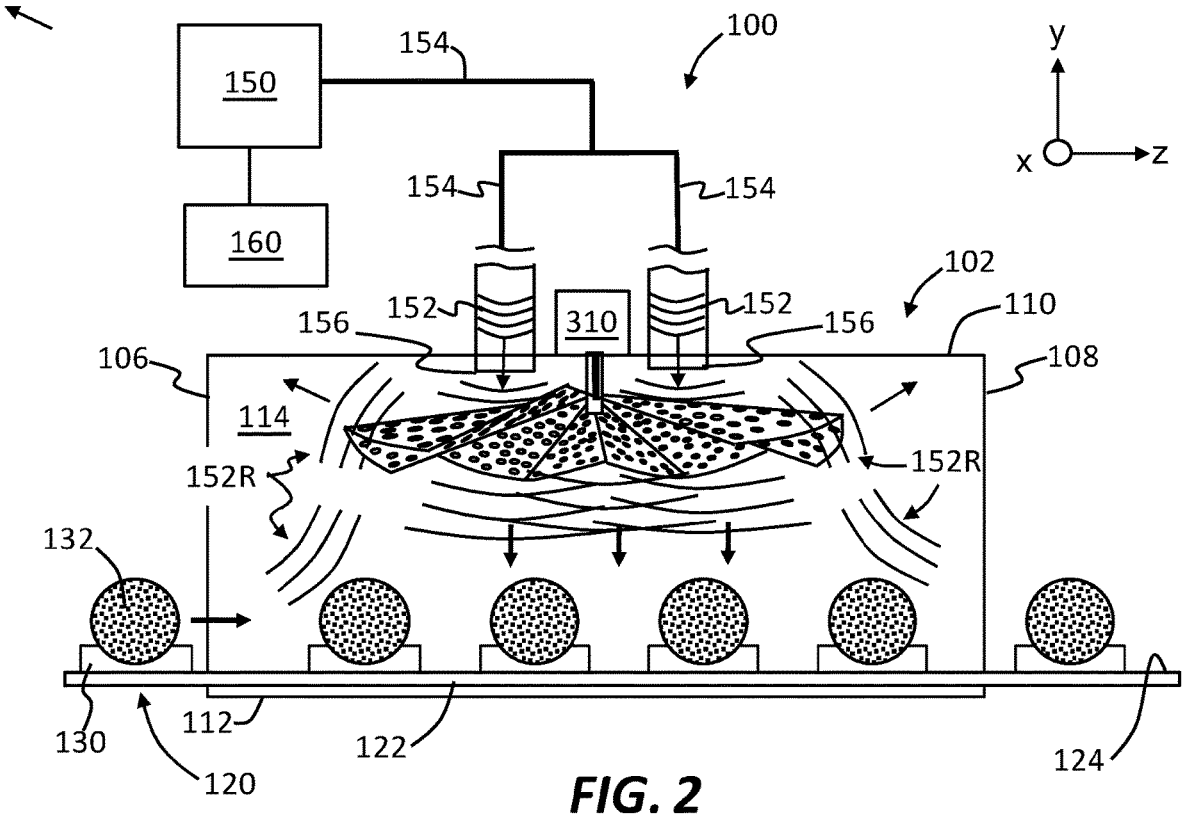
FIG. 2 is a cross-sectional view of the example microwave dryer system of FIG. 1.
Figure 3:
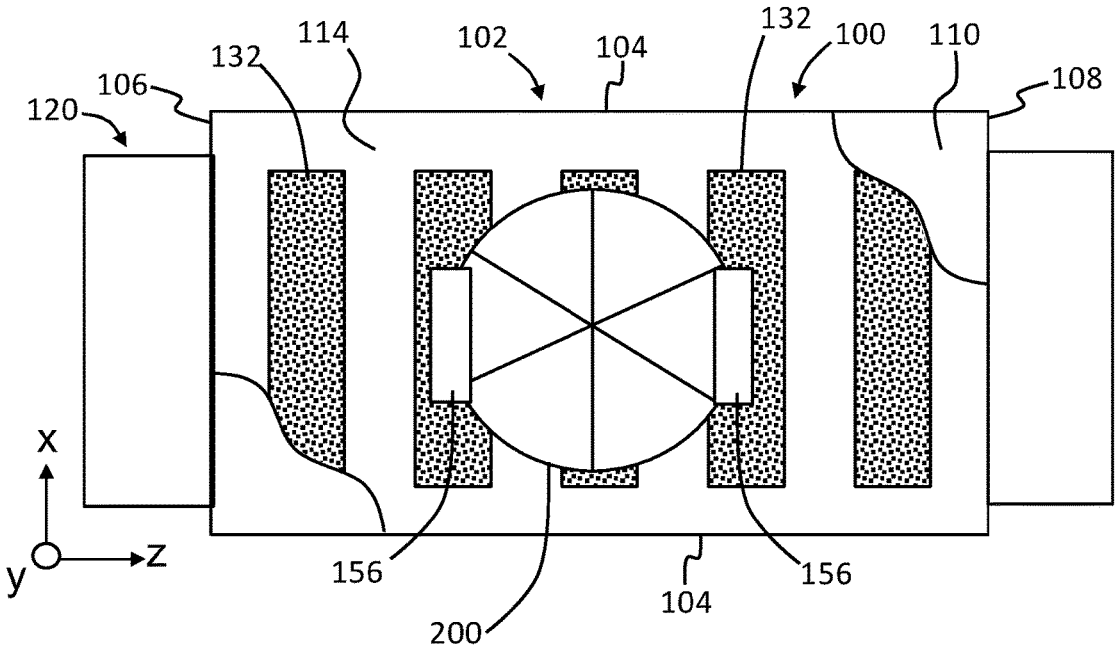
FIG. 3 is a top view of a portion of the microwave dryer system of FIG. 1.

Because the modes may not represent an even distribution of energy within the microwave dryer, they could contribute to the uneven drying of the green ceramic-forming bodies passing therethrough. Thus, in some cases, a mode stirrer apparatus can be used to mix the modes, i.e., disperse the microwave energy, to provide a more uniform distribution of microwave energy and thus more even microwave heating Microwave Dryer System FIG. 1 is a schematic diagram of an example microwave dryer system (or "microwave oven") 100 for heating and drying wet green ceramic-forming bodies 132, according to embodiments shown and described herein. FIG. 2 is a cross-sectional view of the example microwave dryer system 100 of FIG. 1. FIG. 3 is a top view of a portion of the microwave dryer system 100 of FIG. 1.

With reference to FIGS. 1 through 3, microwave dryer 100 comprises a microwave heating chamber 102 having sidewalls 104, an entrance 106, an exit 108, a top 110 and a bottom 112. The sidewalls 104, top 110 and bottom 112 define a chamber interior 114. In one embodiment, the sidewalls 104 top 110 and bottom 112 may be formed from a microwave-impermeable, non-magnetic material that may exhibit a high electrical conductivity and resistance to oxidation at temperatures in the range of 200° C. Each of the top 110, bottom 112 and sidewalls 104 of microwave heating chamber 102 may comprise an inner shell and an outer shell with a layer of insulation (e.g., fiberglass or a comparable insulating material) disposed therebetween.

To facilitate continuous throughput, microwave dryer 100 may comprise a transport system 120 for transporting green ceramic-forming bodies 132 through the chamber interior 114. The transport system 120 may extend through chamber interior 114 of the microwave heating chamber 102 from the entrance 106 to the exit 108. In one embodiment, the transport system 120 comprises a conveyor 122 (e.g., belt or chain link) that runs in the z-direction and passes through chamber interior 114. The conveyor 122 moves in the z-direction from the entrance 106 to the exit 108 and includes an upper surface 124 that carries trays 130 in which green ceramic-forming bodies 132 are respectively supported. The green ceramic-forming bodies 132 are cylindrical and have a central axis A1 and an axial length L. In an example, green ceramic-forming bodies 132 are supported on trays 130 so that their central axes lie in the x-direction, i.e., at right angles to the movement direction of conveyor 122. The microwave heating chamber 102 may be configured such that green ceramic-forming bodies 132 may pass continuously through chamber interior 114 by the operation of conveyor 122.

It should be understood that the transport system 120 may comprise any suitable system for conveying green ceramic-forming bodies 132 through the microwave heating chamber 102 from the entrance 106 to the exit 108.

The microwave dryer 100 comprises a microwave source 150 that generates microwave energy ("microwaves") 152 of wavelength $\lambda$ and a corresponding frequency f. The microwave source 150 is operatively coupled to chamber interior 114 of microwave heating chamber 100. In an example, the operative coupling is via microwave waveguides 154 that comprise output ports 156 in the top 110 of microwave heating chamber 102. Two microwave waveguides 154 and two output ports 156 are shown by way of example.

In an example embodiment, microwave source 150 may comprise a conventional magnetron with an adjustable power feature. The frequency f of the generated microwave energy may be greater than about 900 MHz (0.9 GHz). In one embodiment, the frequency f of the microwave energy generated by the microwave source is from about 10 MHz to about 100 GHz, and, more particularly, frequencies f from about 1 GHz to about 6 GHz which generally corresponds to the industrial microwave band in the United States.

Generally, the microwave source 150 may be operable to vary the power of the emitted microwaves up to about 200 kW. For example, the microwave source 150 may be capable of generating microwave energy 152 having a power of 100 kW with a frequency f of about 915 MHz. Magnetrons of this type may generate microwave energy sufficient to rapidly raise the temperature within the ceramic green body 132 to a drying temperature in as little as 1 to 10 minutes depending on several factors including, without limitation, the load (e.g., the total weight of the green ceramic-forming bodies in the microwave heating chamber including the weight of moisture in the green ceramic-forming bodies), the geometrical configuration of the green ceramic-forming bodies, the compositions of the green ceramic-forming bodies, the positioning of the green ceramic-forming bodies, and the rate at which the green ceramic-forming bodies pass through the microwave heating chamber.

In an example, a circulator (not shown) may be disposed between the microwave source 150 and top 110 of the microwave heating chamber 102 to divert microwave energy 152 that is reflected back into waveguides 154 from chamber interior 114 and that could otherwise return to microwave source 150.

To facilitate control of the microwave source 150, the microwave source may be electrically coupled to a programmable logic controller (PLC) 160. The PLC 160 may be operable to vary the power of the microwave energy generated by the microwave source 150. In one embodiment, the PLC 160 may be operable to send electrical signals to the microwave source 150 to vary the power of the microwave energy 152 generated by the microwave source. The PLC 160 may also be operable to receive signals from the microwave source 150 indicative of the power of the microwave energy being generated by the microwave source 150.

The entrance 106 and exit 108 of the microwave heating chamber 102 may be equipped with shielding (not shown) to reduce radiation leakage from the chamber interior 114 while still permitting the flow of green ceramic-forming bodies 132 into and out of the chamber interior.

In one embodiment, the microwave heating chamber 102 may be multimodal such that the chamber interior 114 can support a large number of resonant modes in a given microwave frequency range. In an example embodiment, a mode stirrer apparatus 200 is driven by a mode stirrer driver 310 (e.g., a motor) and is operably arranged (e.g., adjacent or on the top 110 and/or on sides 104, 106, and 108 of chamber 102) to provide improved uniformity of the microwave energy 152 within the chamber interior to improve the heating and drying of green ceramic-forming bodies 132. Embodiments of mode stirrer apparatus 200 are now discussed below.

Mode Stirrer Apparatus

Figure 4A:
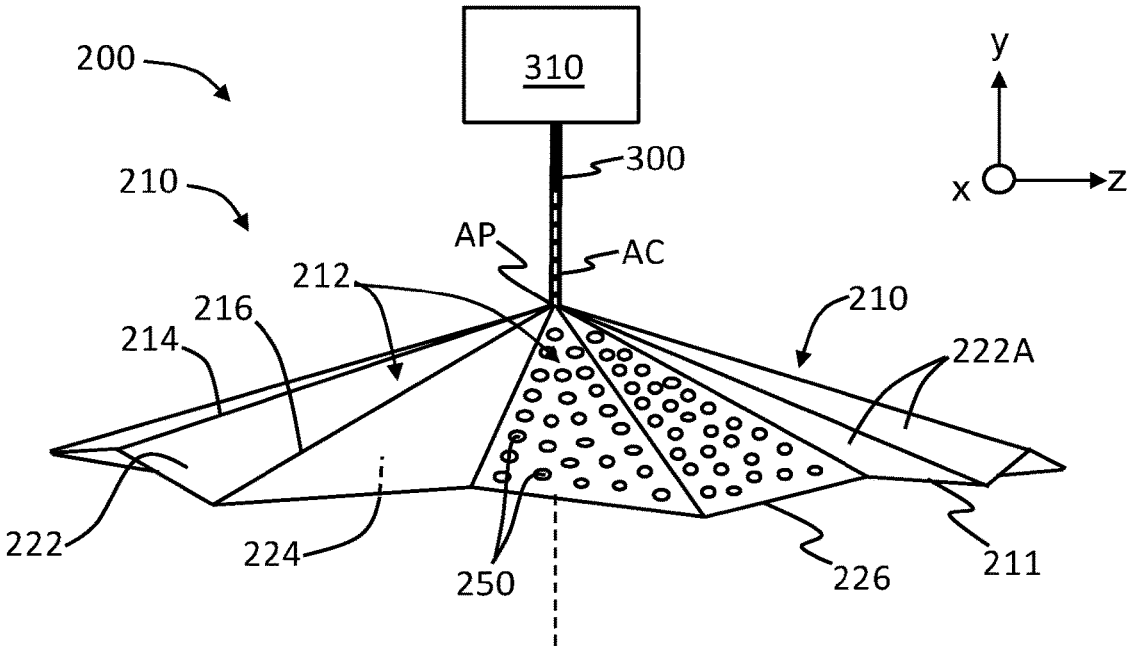
FIG. 4A is top elevated view of an example mode stirrer apparatus according to the disclosure.
Figure 4B:
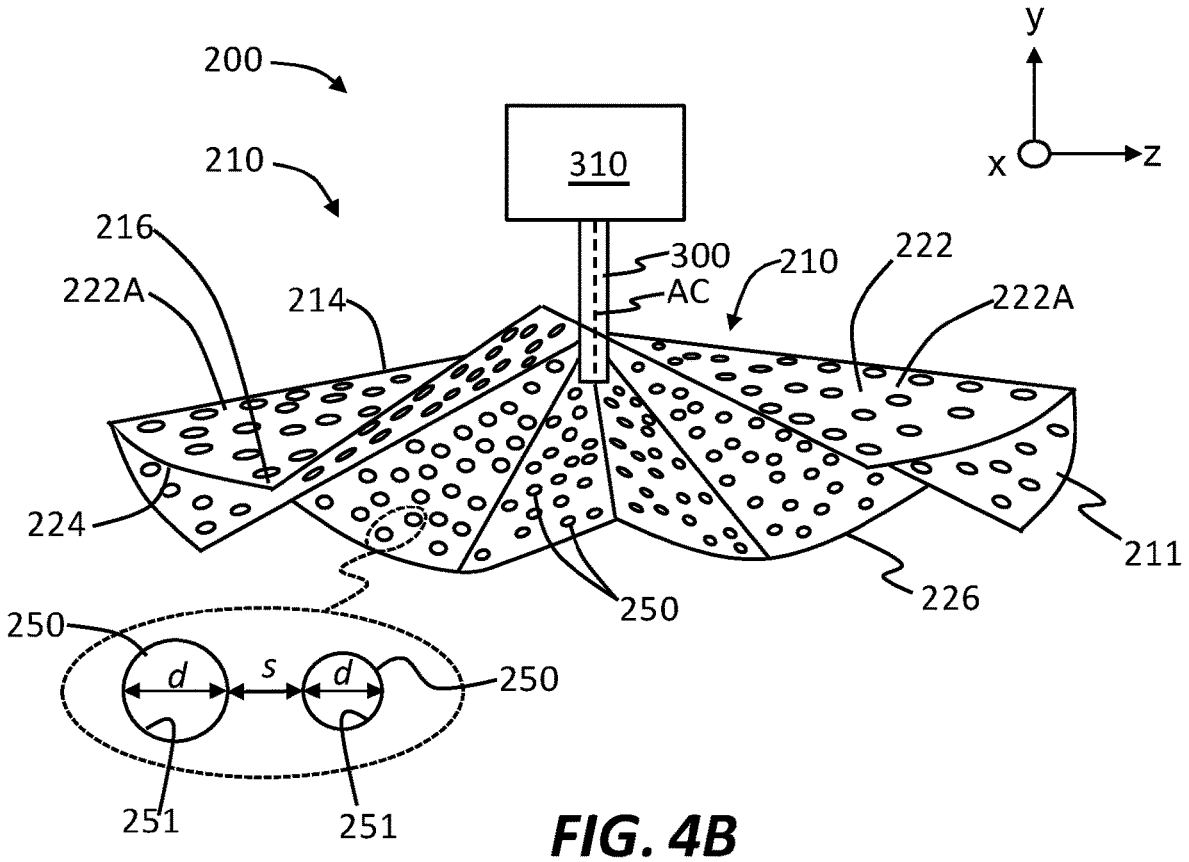
FIG. 4B is a bottom elevated view of an example mode stirrer apparatus according to the disclosure.
Figure 4C:
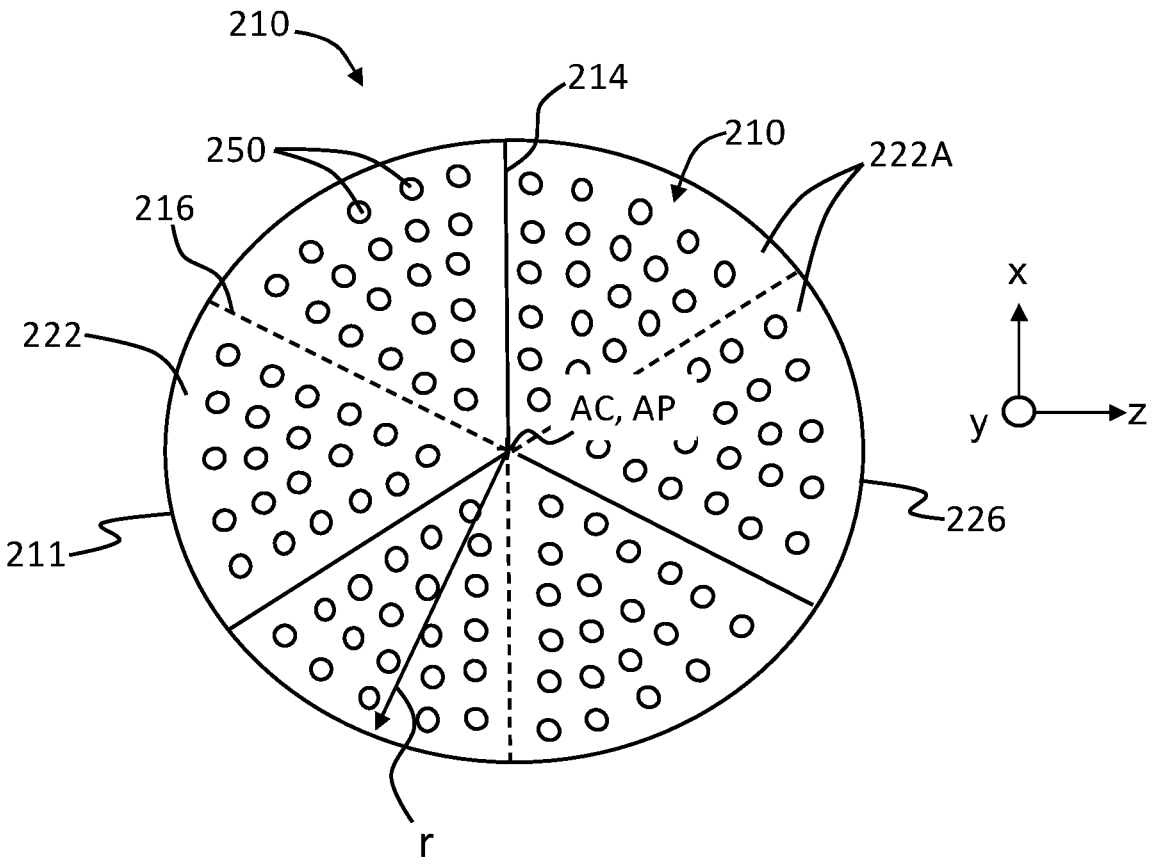
FIG. 4C is a top-down view of the example mode stirring member of the mode stirrer apparatus of FIG. 4B.

FIGS. 4A and 4B are top elevated views of examples of an example mode stirrer apparatus 200 as disclosed herein. The mode stirrer apparatus 200 includes a mode-stirring member ("stirring member") 210. The stirring member 210 can have a variety of shapes and configurations, examples of which are discussed below. FIG. 4C is a top-down view of the example mode stirring member 210 of the mode stirrer apparatus 200 of FIG. 4A.

The stirring member 210 has a body 211, a central axis AC, a top surface 222, a bottom surface 224, and a perimeter 226. The stirring member also includes a plurality of microwave-transmissive regions 250, which are discussed in greater detail below.

Mode stirrer apparatus 200 also comprises a drive shaft 300 that has a proximal end 302 and a distal end 304. The proximal end 302 is operably connected to stirring member 210 and the distal end 304 is operably attached to or otherwise mechanically engaged by drive motor 310.

In the example mode stirrer apparatus 200 shown in FIGS. 2, 3 and 4A through 4C, the example stirring member 210 has the general shape of a cone. The discussion below makes reference to this particular conical stirring member 210 for ease of explanation and it will be understood that the discussion is not limited by reference to this particular stirring member.

Figure 5A:
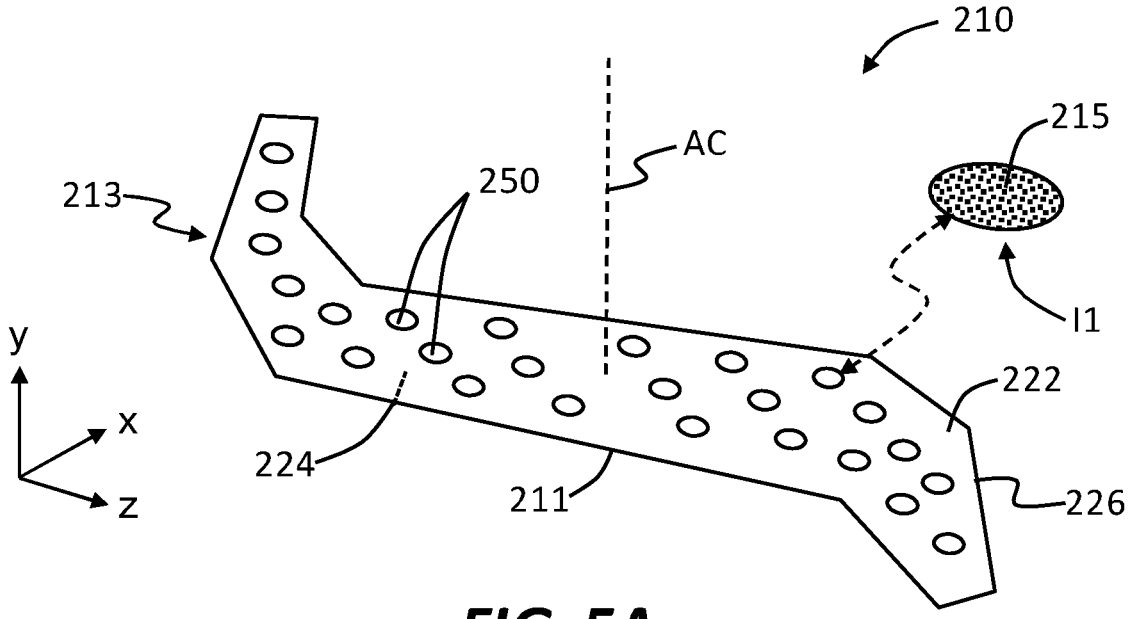
FIG. 5A is a top elevated view of an example mode stirring member that is defined by a single S-shaped blade, and wherein at least some of the microwave-transmissive regions include a microwave-transmissive material, as illustrate in the close-up inset l1.

Other geometries for stirring member 210 besides the example conical stirring member can be used. For example, FIG. 5A is a top elevated view of an example mode stirring member 210 that is defined by a single blade S-shaped blade 213, and wherein at least some of the microwave-transmissive regions include a microwave-transmissive material 215, as illustrated in the close-up inset l1.

Figure 5B:
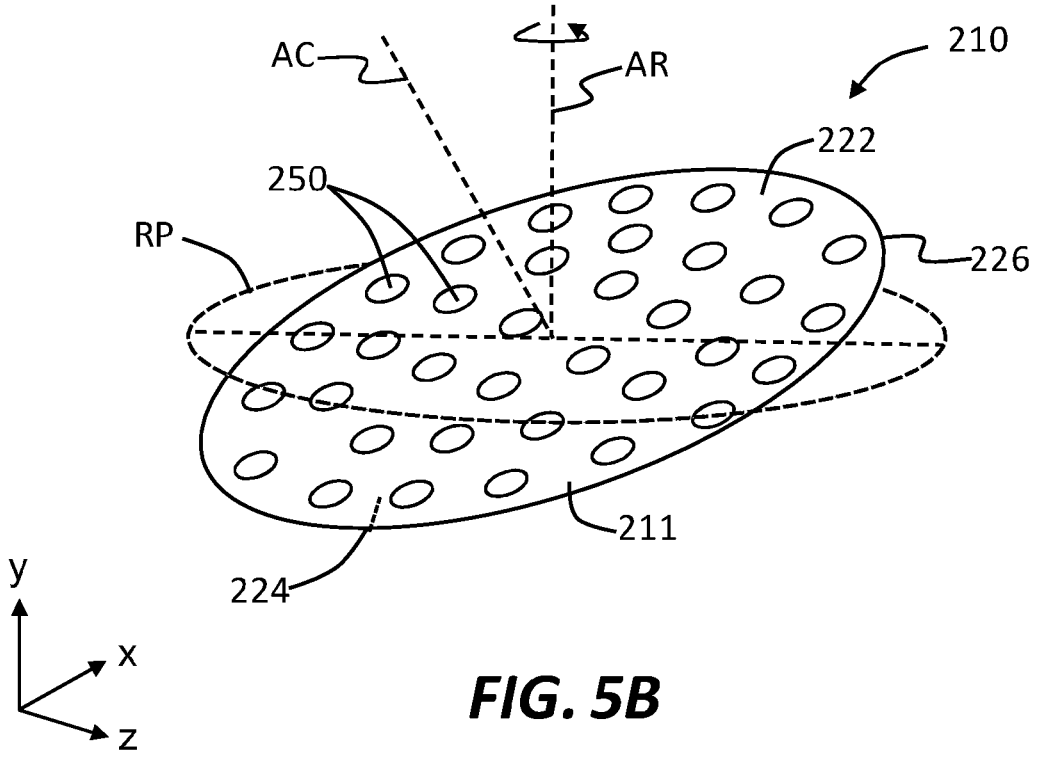
FIG. 5B is a top elevated view of an example mode stirring member that has the form of a circular flat plate, and shows the mode stirring member arranged with its central axis AC at an angle with respect to a rotation axis AX.

FIG. 5B is a top elevated view of an example stirring member 210 that has the form of a circular flat plate. The stirring member 210 arranged with its central axis AC at an angle with respect to a rotation axis AX and thus at an angle with respect to a horizontal plane of rotation RP that resides in the x-z plane.

Figure 5C:
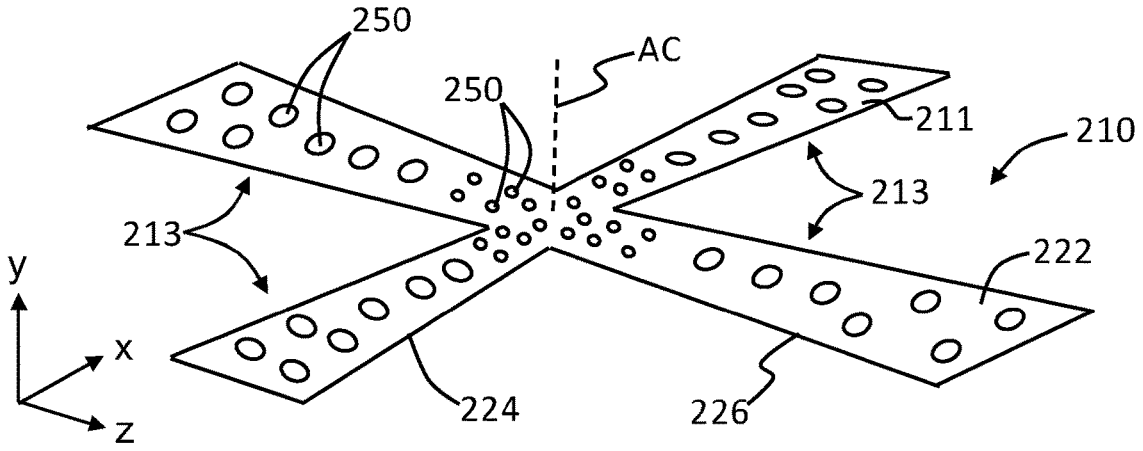
FIG. 5C is a top elevated view of an example mode stirring member that includes four blades.

FIG. 5C is a top elevated view of an example stirring member 210 that includes four blades 213 arranged 90 degrees with respect to one another and that has different sized microwave-transmissive regions 250 in each blade.

Figure 5D:
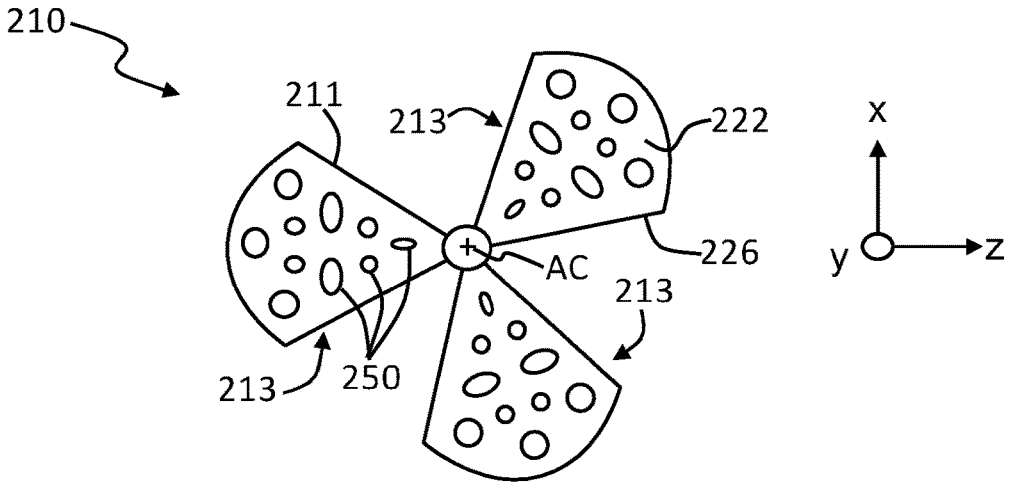
FIG. 5D is a top-down view of an example mode stirring member that includes three wedge-shaped blades.

FIG. 5D is a top-down view of another example stirring member 210 that includes three wedge-shaped blades, wherein each blade includes different sized and different shaped microwave transmissive regions 250.

Figure 5E:
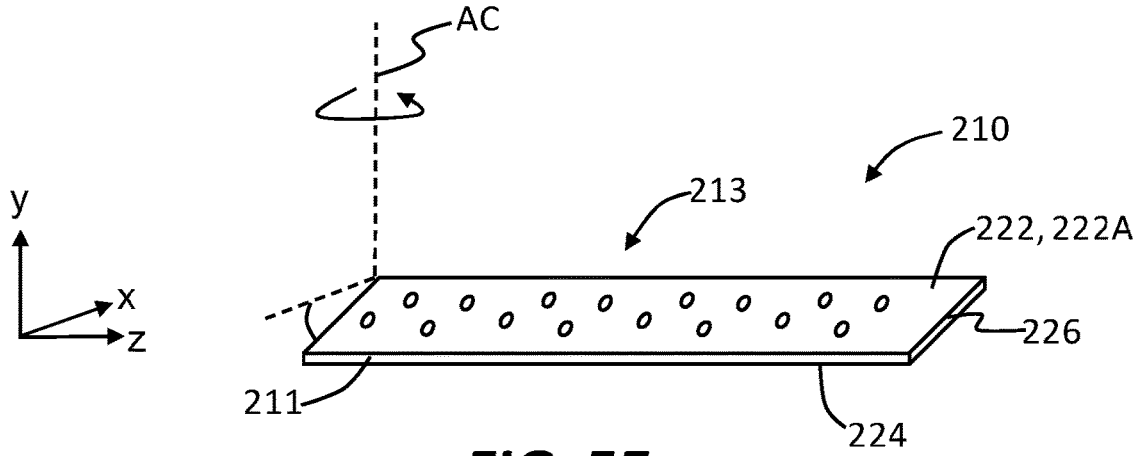
FIG. 5E is a top-elevated view of an example blade of a mode stirring member, wherein the blade is angled with respect to the horizontal (x-z) plane.

FIG. 5E is a top-elevated view of an example blade 213 of a stirring member 210 such as that shown in FIG. 5C, wherein the blade is angled with respect to the horizontal (x-z) plane. Thus, top surface 222 also defines an angled surface 222A.

With reference again to FIGS. 4A through 4C, conical stirring member 210 comprises corrugations 212 that define peaks 214 (solid lines in FIG. 4C) and valleys 216 (dashed lines in FIG. 4C) in top surface 222. The corrugations 212 define a plurality of angled surface portions or facets 222A, as well as an apex AP that resides on central axis AC. The angled surface portions or facets 222A can be measured relative to a plane that is perpendicular the central axis AC, e.g., the horizontal or x-z plane.

Figure 7A:
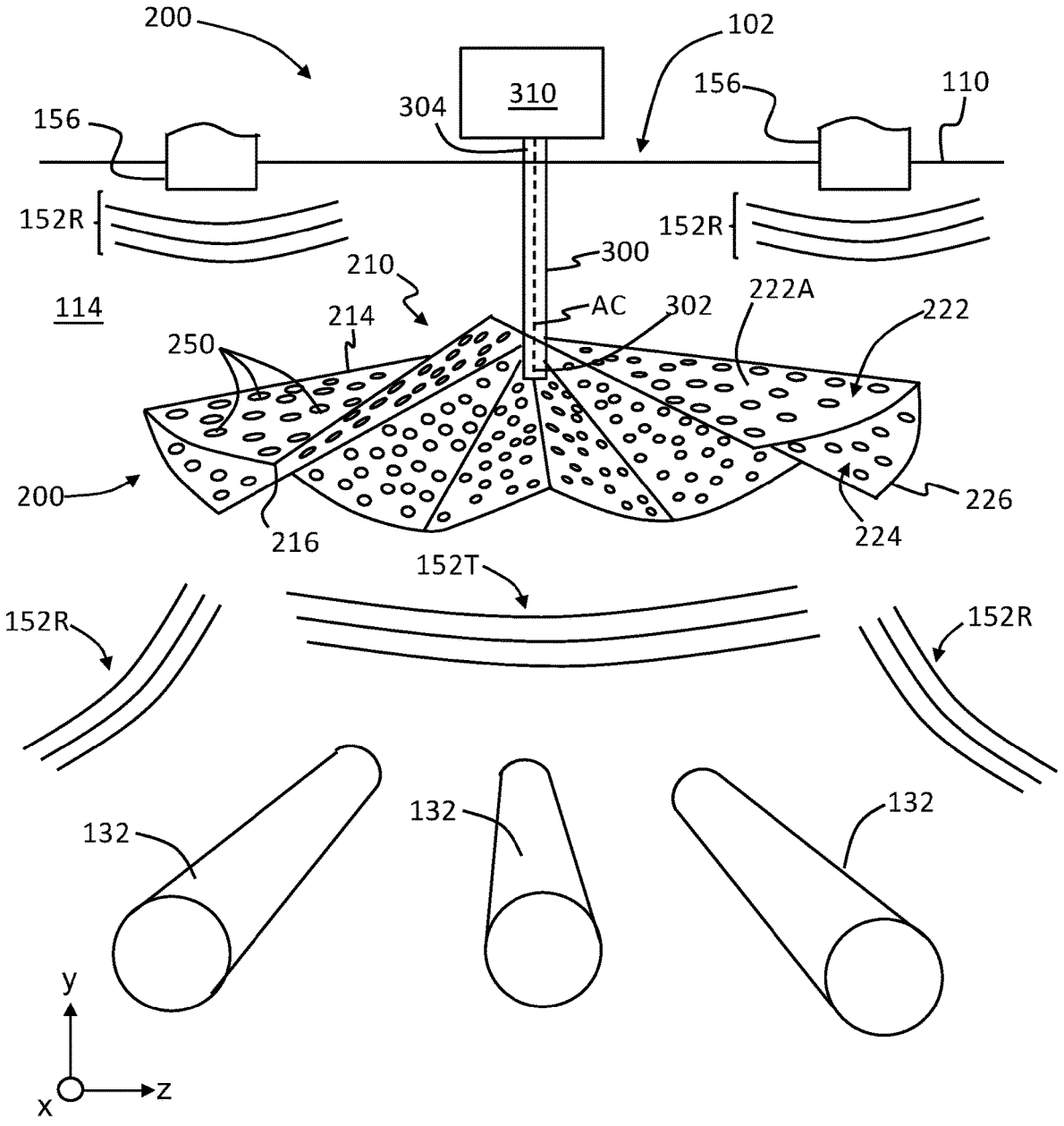
FIG. 7A is an isometric view of an example configuration of the mode stirrer apparatus disposed within the microwave heating chamber.
Figure 7B:
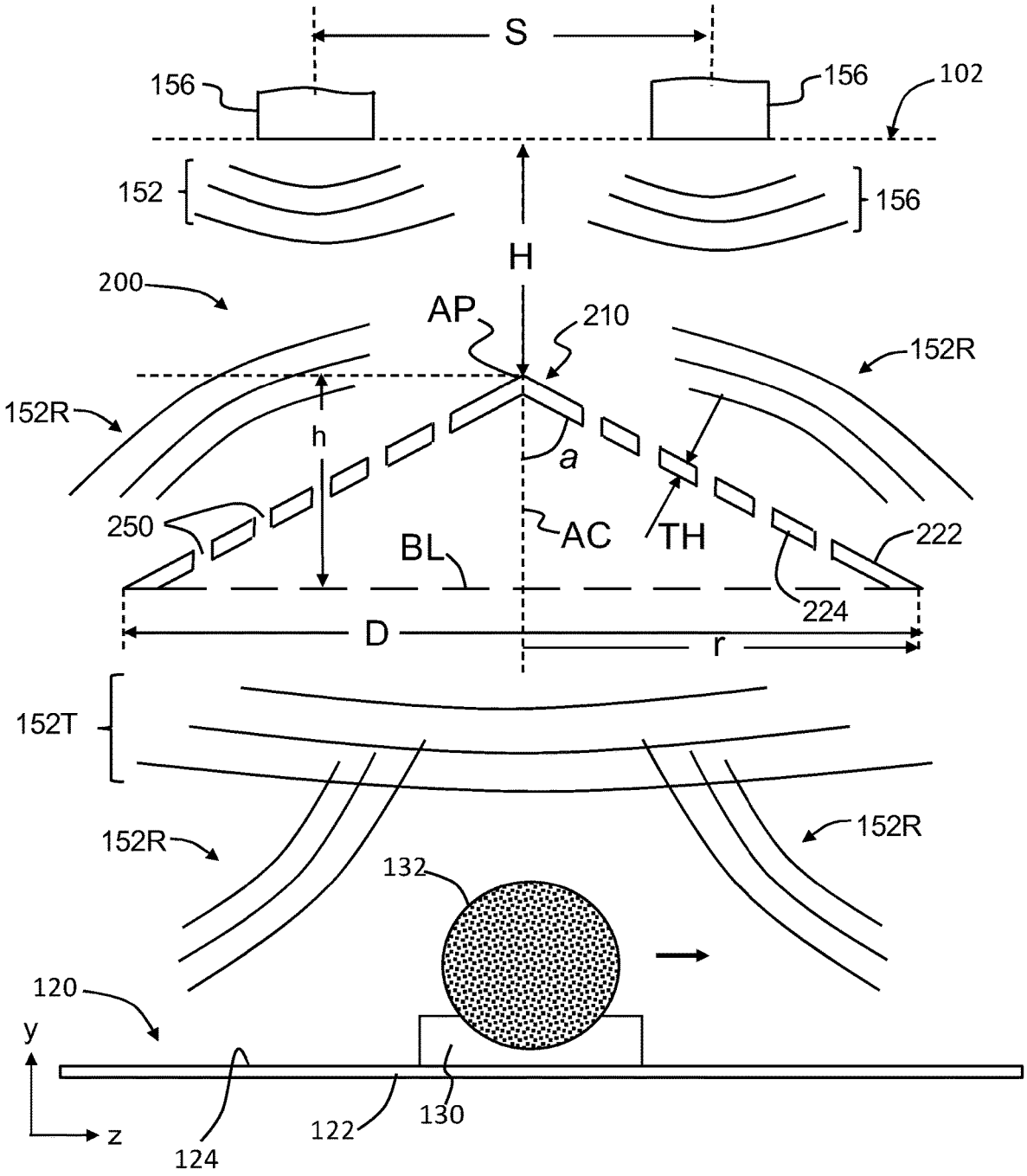
FIG. 7B is a cross-sectional schematic diagram of the example mode stirrer apparatus of FIG. 7A.

With reference also to FIG. 7B introduced and discussed below, conical stirring member 210 has a radius r (FIG. 4C) and a half-angle a ("apex angle") at apex AP (FIG. 7B). In an example, the apex angle a is in the range from 5 degrees to just under 90 degrees (e.g., 89 degrees), with a=90 degrees corresponding to an embodiment wherein body 211 is a flat plate. The body 211 conical stirring member 210 also has a thickness TH, which in an example is in the range from 10 mils to 200 mils. The conical stirring member 210 also has a maximum dimension (e.g. diameter) D, which in an example is in the range from 24 inches to 72 inches. In an example, the base diameter is defined by the center-to-center spacing S between waveguide output ports 156, wherein D≥S, and further in an example S≤D≤(1.5)S. The conical stirring member 210 also has a height h that is measured from a base line BL to apex AP.

The example conical stirring member 210 of FIGS. 4A and 4B shows six corrugations 212, where the number N of corrugations is defined by the number $N_P$ of peaks 214 or the number of valleys $N_V$ 216, wherein $N_P=N_V$. The corrugations can be relatively sharp, such as shown in FIG. 4A, or can be relatively smooth or rounded. The six corrugations 212 define twelve angle surfaces 222A. A main purpose of the conic shape of conical stirring member 210 is to deflect microwaves 152 towards the walls 104 of chamber 102 rather than back into waveguide output ports 152. Likewise, the angled surface portions 222A serve to change the angle of reflection of microwaves 152 from surface 222 as the mode stirrer rotates about its central axis AC, which helps to mix or "stir" the microwave modes within chamber interior 114, as discussed below.

Microwave-Transmissive Regions

Figure 6A:
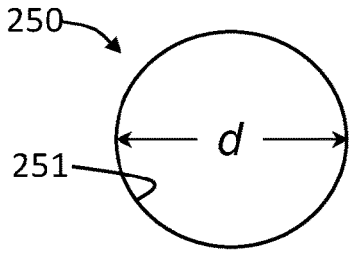
FIGS. 6A through 6G show seven different example shapes of the microwave-transmissive regions and the corresponding maximum dimension d, wherein the example shapes are circular, oval, square, rectangular, polygonal (e.g., hexagonal) irregular and a recess at the perimeter, respectively.
Figure 6B:
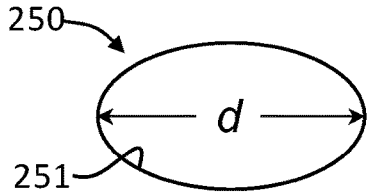
Figure 6C:
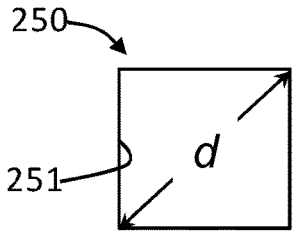
Figure 6D:
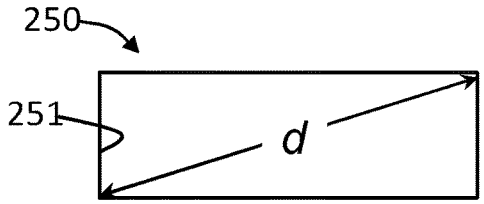
Figure 6E:
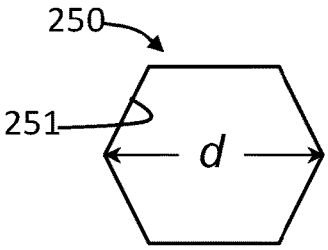
Figure 6F:
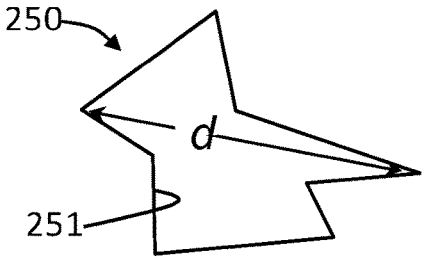
Figure 6G:
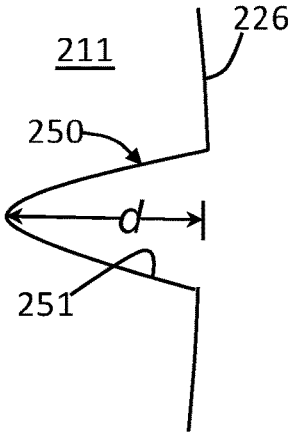

As discussed above, stirring member 210 of mode stirrer apparatus 200 includes a plurality of microwave-transmissive regions 250 that are formed in body 211 and that are each defined by an inner surface 251. In an example, the microwave-transmissive regions 250 are defined by openings or perforations that extend from the top surface 222 to the bottom surface 224. In an example, microwave-transmissive regions 250 reside within perimeter 256, i.e., the inner surface 251 does not intersect the perimeter. In another example, at least one of the microwave-transmissive region 250 intersects perimeter 226 of body 211 and forms a recess (e.g., a groove or a slot) in the perimeter that extends inwardly from the perimeter (see FIG. 6G, introduced and discussed below). In an example, all of the microwave-transmissive regions 250 reside within perimeter 226, i.e., there are no recess type of microwave-transmissive regions formed in the perimeter.

In an example, microwave-transmissive regions are substantially evenly distributed over body 211. In an example, the microwave-transmissive regions 250 are "holes" in the sense that there is no solid material of body 211 present within the microwave-transmissive region. An advantage of microwave-transmissive regions 250 in the form of holes is that the holes can act as a means for allowing steam to pass through the stirring member 210 during the drying process, thereby reducing the chances of condensation forming on the green ceramic-forming bodies. In another example, one or more of the microwave-transmissive regions 250 are filled with a microwave transmissive material 215, e.g., a dielectric material, such as shown in FIG. 5A and mentioned above. In another example, microwave-transmissive regions 250 are randomly distributed over body 211.

FIG. 4A shows only two of the angled surfaces 222A of conical stirring member 210 as having microwave-transmissive regions 250 for the sake of illustration. In an example, all the angled surfaces 222A include microwave-transmissive regions. FIG. 4B includes close-up view of two example circular microwave-transmissive regions 250 of diameter d and spaced apart by an-edge-to-edge spacing s.

Also in an example, microwave-transmissive regions 250 have substantially the same size (i.e., d is the same for all microwave-transmissive regions) while in another example such as shown in the close-up inset of FIG. 4B, the microwave-transmissive regions 250 can vary in size (i.e., d need not be the same for all microwave-transmissive regions). In an example where microwave-transmissive regions 250 are not circular in shape, the dimension d corresponds to a largest dimension, such as measured along the major axis of an oval-shaped microwave-transmissive region.

FIGS. 6A through 6G show seven different example shapes of the microwave-transmissive regions 250 and the corresponding maximum dimension d, wherein the example shapes are circular (FIG. 6A), oval (FIG. 6B), square (FIG. 6C), rectangular slit (FIG. 6D), polygonal (e.g., hexagonal) (FIG. 6E), irregular (FIG. 6F) and open at perimeter 226 to form a recess (i.e., a groove or a slot) therein.

In an example, stirring member 210 has M microwave-transmissive regions 250, wherein M is between 10 and 1000. In an example, each angled section 222A of conical stirring member 210 includes between 5 and 150 microwave-transmissive regions 250.

In an example, the spacing s between microwave-transmissive regions 250 need not be uniform. For example, the spacings can vary as a function of position of the microwave-transmissive regions on body 211. In an example, the dimension d of at least some of microwave-transmissive regions 250 is λ/15 so that transmitted microwave radiation 152T dimension d of microwave-transmissive regions is in the range 0.025λ≤d≤0.5λ. Thus, for microwave radiation having a wavelength λ of about 33 cm, microwave-transmissive regions can have a dimension d in the range from 0.8 cm to 16.5 cm.

In another example where substantially higher transmitted microwave radiation 152T is desired, then the dimension d of at least some of the microwave-transmissive regions can satisfy the relation d>0.5λ.

FIG. 7A is an isometric view of an example mode stirrer apparatus 200 illustrating some example geometrical properties and parameters while FIG. 7B is a cross-sectional view in the x-z plane of the mode stirrer of FIG. 5A.

With reference to FIG. 2 and FIGS. 7A and 7B, stirring member 210 of mode stirrer apparatus 200 is supported by drive shaft 300 such that the stirring member resides within chamber interior 114 adjacent top surface 110 of microwave heating chamber 102 and between the one or more microwave output ports 156 and transport system 120. The surface 222 (or apex AP in the case of conical stirring member 210) is a distance H away from top surface 110 of heating chamber 102. The microwaves 152 are emitted from each of the one or more waveguide output ports 156 and are incident upon stirring member 210. Meanwhile, drive motor 310 is activated and rotatably drives the drive shaft 300, which causes stirring member 210 to rotate about its central axis AC.

A portion of the emitted microwaves 152 reflects from the surface 222 of stirring member 210 to form reflected microwaves 152R, while another portion of the microwaves is transmitted through microwave-transmissive regions 250 to form transmitted microwaves 152T. In an example, reflected microwaves 152R reflects from at least one of the walls 106, top 110 and bottom 112 of heating chamber 102 before reaching green ceramic-forming bodies 132 being conveyed through chamber interior 114 by transport system 120. The transmitted microwaves 152T reach the green ceramic-forming bodies 132 via a more direct route through microwave-transmissive regions 250.

The rotation of stirring member 210 "stirs" the microwaves 152, meaning that the reflected microwaves 152R within the chamber interior 114 are redirected in a time-varying manner that prevents stationary microwave modes from being established within the chamber interior. The rotation of stirring member 210 also moves the location of the transmitted microwaves 152 on a time-varying basis, i.e., the stirring member does not act merely as a shutter. The stirring of the microwaves 152 is facilitated by stirring member 210 having at least one angled surface 222A, such as the conical stirring member 210, or by having the stirring member itself angled with respect to the horizontal plane, such as shown in the example stirring member of FIG. 5C. An example rotation rate of stirring member 210 is between 1 revolution-per-minute (RPM) to 20 RPM.

In an example, the initially emitted microwaves 152 from the at least one microwave output port 156 have a microwave power PE while the reflected microwaves 152R have a microwave power PR and the transmitted microwaves have a microwave power PT. The microwave-transmissive regions can be used to tailor the relative amounts of reflected and transmitted microwave radiation 152R and 152T to optimize the drying uniformity of green ceramic-forming bodies 132. In an example, microwave-transmissive regions are configured such that the power ratio PT/PR is in the range $0.01 \leq PT/PR \leq 0.5$, while in another example $0.05 \leq PT/PR \leq 0.5$, while in yet another example $0.1 \leq PT/PR \leq 0.5$.

In an example, the heating (and thus the drying) of green ceramic-forming bodies 132 is more uniform by using stirring member 210 and its microwave-transmissive regions 250 as compared to using the same stirring member 210 but without the microwave-transmissive regions (i.e., using a "solid" or "unperforated" stirring member). In an example, the improvement in the heating (and thus drying) uniformity over the green ceramic-forming bodies 132 is evidenced by the absence of wet regions in the green ceramic-forming bodies. Such wet regions have been found to occur during drying with mode stirring apparatus that do not comprise microwave-transmissive regions 250 as disclosed herein. Here, a "wet region" refers to a region of the green ceramic-forming body 132 that does not meet a given drying specification as defined, for example by less than a maximum amount of liquid content being present upon completion of drying.

Figure 8A:
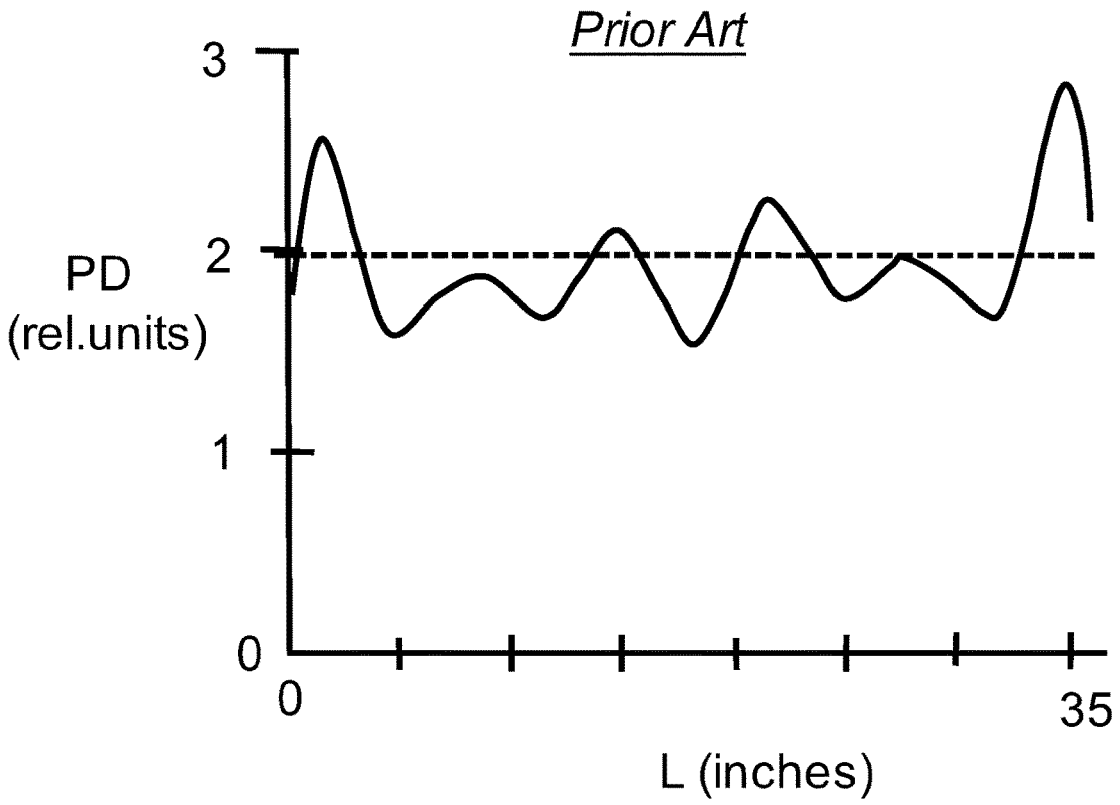
FIG. 8A is a plot of the integrated dissipated microwave power PD (relative units) versus the length L (inches) of an example green ceramic-forming body, for a microwave dryer that used a conventional mode stirrer, wherein the integrated power dissipation is shown to vary about value indicated by the dashed line.
Figure 8B:
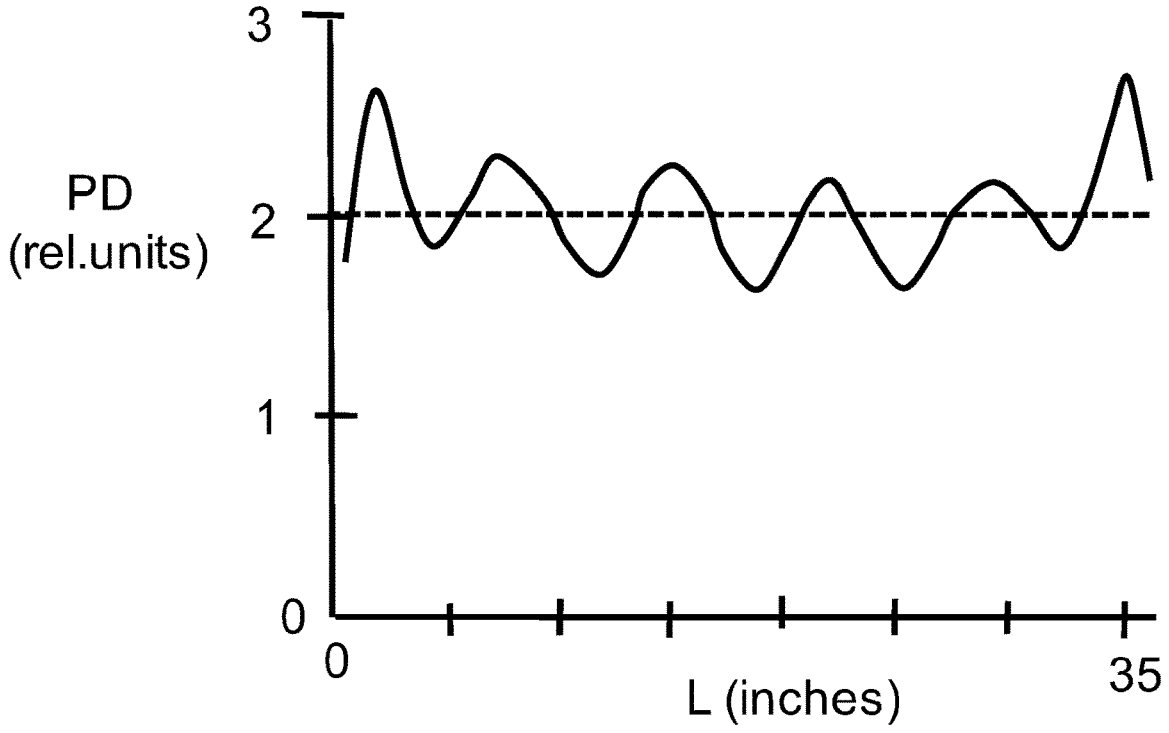
FIG. 8B is a plot similar to FIG. 8A for the same microwave drying but using the mode stirrer apparatus as disclosed herein, wherein the plot shows a reduced variation in integrated power dissipation about the dashed line.

FIG. 8A is a plot of the integrated dissipated microwave power PD (relative units) versus the length L (inches) as measured on a green ceramic-forming body 132 for a comparative microwave drying configuration that used a conventional mode stirrer that did not have any microwave-transmissive regions. The integrated power dissipation varies substantially about value of about 2, as indicated by the dashed line. FIG. 8B is a plot similar to FIG. 8A for the same drying configuration but using the mode stirrer apparatus 200 as disclosed herein. The plot shows a reduced variation (i.e., greater uniformity) in integrated power dissipation about the dashed line, indicating the effectiveness in mode stirrer apparatus 200 in reducing the amount of microwave power variation when drying green ceramic-forming body 132. The reduced dissipated power near the central regions of the variation translate directly into reduced drying non-uniformities.

It will be apparent to those skilled in the art that various modifications to the preferred embodiments of the disclosure as described herein can be made without departing from the spirit or scope of the disclosure as defined in the appended claims. Thus, the disclosure covers the modifications and variations provided they come within the scope of the appended claims and the equivalents thereto.

What is claimed is:

1. A mode stirrer apparatus for stirring microwave radiation having a wavelength λ from at least one microwave radiation source, comprising:

a stirring member having a body that substantially reflects microwave radiation, the stirring member having a perimeter and central axis around which the stirring member can rotate; and a plurality of microwave-transmissive regions formed in the body and within the perimeter, wherein the microwave-transmissive regions are configured to substantially transmit the microwave radiation, wherein the stirring member comprises corrugations that define a plurality of angled sections joined together altematingly at a plurality of peaks and a plurality of valleys, such that each angled section is transverse as measured relative to a plane that is perpendicular to the central axis, wherein the plurality of angled sections are arranged about the central axis in a conical shape having an axis, with the central axis passing through the apex, wherein the microwave-transmissive regions each have a maximum dimension d in the range $0.025\lambda \leq d \leq 0.5\lambda$, and wherein a number of the plurality of microwave-transmissive regions in the stirring member is between 10 and 1000.

2. The apparatus according to claim 1, wherein the microwave-transmissive regions have the same size and shape.

3. The apparatus according to claim 1, wherein the microwave-transmissive regions all have either a circular shape or an oval shape.

4. The apparatus according to claim 1, wherein the microwave-transmissive regions are substantially evenly distributed over the body.

5. The apparatus according to claim 1, wherein all of the microwave-transmissive regions reside entirely within the perimeter.

6. The apparatus according to claim 1, wherein the microwave-transmissive regions comprise openings in the body.

7. The apparatus according to claim 1, further comprising a drive shaft having a proximal end and a distal end, wherein the proximal end is operably connected to the stirring member, and a drive motor operably connected to the distal end of the drive shaft and configured to impart a rotation to the stirring member by axially rotating the drive shaft.

8. The mode stirrer of claim 1, wherein the number of microwave-transmissive in each angled section is between 5 and 150.

9. A microwave oven for drying green ceramic-forming bodies, comprising:

a microwave chamber within which green ceramic-forming bodies can be arranged for microwave drying;

a microwave source to emit microwaves having a wavelength λ into the microwave chamber;

the mode stirrer of claim 1 rotatable disposed in the microwave chamber.

10. The microwave oven according to claim 9, wherein the body of the rotatable mode stirring member includes a plurality of angled facets.

11. The microwave oven according to claim 9, wherein the body comprises a conical shape.

12. A mode stirrer apparatus according for stirring microwave radiation having a wavelength λ from at least one microwave radiation source, comprising:

a stirring member having a body that substantially reflects microwave radiation, the stirring member having a perimeter and central axis around which the stirring member can rotate; and a plurality of microwave-transmissive regions formed in the body and within the perimeter, wherein the microwave-transmissive regions are configured to substantially transmit the microwave radiation, wherein the microwave-transmissive regions each have a maximum dimension d in the range $0.025\lambda \leq d \leq 0.5\lambda$, wherein a number of the plurality of microwave-transmissive regions in the stirring member is between 10 and 1000, and wherein the microwave radiation is emitted from two or more output ports operably coupled to the at least one microwave source and that are spaced apart by a center-to-center distance S, and wherein the stirring member has a dimension $D \geq S$.

13. The apparatus according to claim 1, wherein one or more of the microwave-transmissive regions comprises a microwave-transmissive material.

* * * * *